US011352181B2

(12) United States Patent
Apps et al.

(10) Patent No.: US 11,352,181 B2
(45) Date of Patent: Jun. 7, 2022

(54) LOW DEPTH CRATE

(71) Applicant: Rehrig Pacific Company, Los Angeles, CA (US)

(72) Inventors: William P. Apps, Alpharetta, GA (US); Suzanne Whitfield Clark, Atlanta, GA (US)

(73) Assignee: Rehrig Pacific Company, Los Angeles, CA (US)

( * ) Notice: Subject to any disclaimer, the term of this patent is extended or adjusted under 35 U.S.C. 154(b) by 341 days.

(21) Appl. No.: 14/275,027

(22) Filed: May 12, 2014

(65) Prior Publication Data

US 2015/0014200 A1 Jan. 15, 2015

Related U.S. Application Data

(60) Provisional application No. 61/821,952, filed on May 10, 2013.

(51) Int. Cl.
*B65D 71/70* (2006.01)
*B65D 1/22* (2006.01)

(52) U.S. Cl.
CPC ..... *B65D 71/70* (2013.01); *B65D 1/22* (2013.01)

(58) Field of Classification Search
CPC ..... B65D 1/243; B65D 1/36
USPC ..... 220/509, 516, 517, 519, 770, 771
See application file for complete search history.

(56) References Cited

U.S. PATENT DOCUMENTS 2,788,933 A 4/1957 Kessler
3,106,308 A * 10/1963 Kazimier ..... 220/512
4,249,671 A 2/1981 Crolli
4,349,121 A 9/1982 Lafferty
4,846,365 A 7/1989 Steinlein
4,899,874 A 2/1990 Apps et al.
4,932,532 A 6/1990 Apps et al.
4,978,002 A 12/1990 Apps et al.
5,009,053 A 4/1991 Langenbeck et al.
5,060,819 A 10/1991 Apps et al.
5,184,748 A 2/1993 Apps et al.
5,230,601 A 7/1993 Apps et al.
5,267,649 A 12/1993 Apps et al.
(Continued)

OTHER PUBLICATIONS

US 4,987,995 A, 01/1991, Apps et al. (withdrawn)
Decision on Appeal for U.S. Appl. No. 14/710,124 dated May 12, 2021.

*Primary Examiner* — J. Gregory Pickett
*Assistant Examiner* — Niki M Eloshway
(74) *Attorney, Agent, or Firm* — Carlson, Gaskey & Olds, P.C.

(57) ABSTRACT

A beverage crate include a base, a pair of opposed side walls extending upward from the sides of the base and a pair of end walls extending upward from ends of the base. The end walls each include a pair of spaced apart end columns. A handle extends across the pair of spaced apart columns at each end wall. The height of the handle is aligned with a portion of the bottle having a reduced diameter. For example, some bottles have a tapered or contoured middle portion to facilitate grasping the bottle. This allows the handle to be positioned closer to the bottles, which reduces the overall length of the crate. The reduced length of the crate then permits a reduced width of the crate per the required ratio for cross-stacking. The reduced width then permits a full bottle capture on the bottom surface of the crate.

18 Claims, 21 Drawing Sheets

(56) References Cited

U.S. PATENT DOCUMENTS 5,273,175 A 12/1993 Apps
5,277,316 A 1/1994 Apps et al.
5,285,899 A 2/1994 Apps et al.
5,305,884 A 4/1994 Apps et al.
5,316,172 A 5/1994 Apps et al.
5,320,245 A 6/1994 Apps et al.
5,323,925 A 6/1994 Apps
5,351,814 A 10/1994 Apps
5,405,042 A * 4/1995 Apps ..... B65D 85/305 206/203
5,445,273 A 8/1995 Apps
5,465,843 A 11/1995 Koefelda
5,495,945 A 3/1996 Apps et al.
5,501,352 A 3/1996 Apps
5,529,176 A 6/1996 Apps et al.
5,575,390 A 11/1996 Apps et al.
5,651,461 A 7/1997 Apps et al.
5,660,279 A 8/1997 Apps et al.
5,704,482 A 1/1998 Apps et al.
5,842,572 A 12/1998 Apps et al.
5,855,277 A 1/1999 Apps et al.
5,979,654 A 11/1999 Apps et al.
6,073,793 A 6/2000 Apps et al.
6,186,328 B1 2/2001 Apps
6,454,120 B1 * 9/2002 Hammett ..... 220/515
6,457,599 B1 10/2002 Apps et al.
6,892,885 B2 5/2005 Apps et al.
6,899,247 B1 5/2005 Koefelda et al.
6,966,442 B2 11/2005 Hassell et al.
7,017,746 B2 3/2006 Apps
7,036,666 B2 * 5/2006 Hammett ..... 206/503
7,086,531 B2 8/2006 Apps et al.
7,093,715 B1 8/2006 Apps
7,097,033 B2 8/2006 Koefelda et al.
7,128,234 B2 10/2006 Apps et al.
7,207,458 B1 4/2007 Koefelda et al.
7,252,196 B1 8/2007 Koefelda et al.
7,281,641 B2 10/2007 Apps
7,311,217 B2 12/2007 Apps
7,322,475 B2 1/2008 Hassell et al.
7,322,486 B2 1/2008 Koefelda et al.
7,448,493 B2 11/2008 Wong
7,549,539 B2 6/2009 Apps
7,604,122 B2 10/2009 Apps et al.
7,658,278 B2 2/2010 Apps et al.
7,677,405 B2 3/2010 Apps et al.
7,694,839 B2 4/2010 Koefelda et al.
7,699,184 B2 4/2010 Meissen
7,735,676 B2 6/2010 Ogburn
7,743,939 B2 6/2010 Stahl
7,950,521 B2 5/2011 Apps
8,056,753 B2 11/2011 Koefelda et al.
8,109,408 B2 * 2/2012 Hassell ..... 220/516
8,123,034 B2 2/2012 Apps et al.
8,146,746 B2 4/2012 Apps
8,186,534 B2 5/2012 Apps
8,353,402 B2 1/2013 Apps
8,448,806 B2 5/2013 Hassell
8,517,203 B2 8/2013 Apps
8,636,142 B2 1/2014 Apps
8,672,161 B2 * 3/2014 Apps ..... 220/23.88
8,720,688 B2 * 5/2014 Hassell et al. ..... 206/509
8,893,891 B2 11/2014 Apps
9,010,536 B2 4/2015 McCanless et al.
9,114,901 B2 8/2015 Apps
9,321,572 B2 4/2016 Apps et al.
9,475,602 B2 10/2016 Apps
2001/0015329 A1 8/2001 Apps et al.
2001/0019063 A1 9/2001 Apps
2002/0148837 A1 10/2002 Apps
2002/0195452 A1 * 12/2002 Apps ..... 220/515
2003/0029870 A1 2/2003 Apps et al.
2003/0057211 A1 3/2003 Koefelda et al.
2003/0070957 A1 4/2003 Apps et al.
2003/0075546 A1 * 4/2003 Hammett ..... 220/519
2004/0140238 A1 7/2004 Hassell et al.
2005/0040069 A1 2/2005 Apps et al.
2005/0067314 A1 3/2005 Koefelda et al.
2005/0133386 A1 6/2005 Wong
2005/0279651 A1 * 12/2005 Perret et al. ..... 206/203
2007/0012590 A1 1/2007 Nyeboer
2010/0230318 A1 9/2010 Stahl
2014/0102933 A1 4/2014 Meers et al.
2014/0110303 A1 4/2014 Meers et al.
2014/0158576 A1 6/2014 McCanless et al.
2015/0014200 A1 1/2015 Apps et al.
2015/0100428 A1 4/2015 Parkinson, Jr.
2015/0203247 A1 7/2015 Apps
2015/0344167 A1 12/2015 Clark
2016/0016689 A1 1/2016 Apps et al.
2016/0159542 A1 6/2016 Meers
2016/0200479 A1 7/2016 Clark et al.
2016/0200480 A1 7/2016 Clark

* cited by examiner

LOW DEPTH CRATE

BACKGROUND OF THE INVENTION

The present invention relates generally to crates and more particularly to crates for carrying beverage containers, such as bottles.

Many designs for crates for carrying beverage containers are known. Some crates include a base having a pair of opposed side walls and a pair of opposed end walls extending upwardly from the periphery of the base. For crates carrying smaller containers, e.g., approximately 16 to 24 ounce bottles, the bottles are typically arranged in a 4×6 arrangement, with four bottles arranged along each end wall. In this arrangement, the center of the handle is aligned between two of the bottles, thus providing sufficient room for the fingers of the user's hand grasping the handle. However, with bottles arranged with an odd number of bottles (e.g. three bottles) along each end wall, one of the bottles is aligned with the center of the handle, thus reducing the amount of space for the user's fingers. This is more typically done with larger bottles, such as 28 oz or 32 oz bottles, or larger.

Therefore, with an odd number of bottles along the end wall, the handle is moved outward from the bottle to increase the space for the user's fingers; however, this has drawbacks. First, the overall footprint of the crate is increased in that dimension. Second, if the crate is intended to be capable of cross-stacking, a certain ratio of length-to-width of the crate must be maintained. Therefore, the width of the crate must be increased as a result of moving the handle outward, further increasing the footprint. As another result of the increased width of the crate, bottle capture areas (recesses) on the bottom of the crate must be eliminated or opened up in order to accept the bottle caps of bottles of a crate cross-stacked therebelow. The bottle capture recesses may not fully capture the caps of the bottles and thus not provide stacking that is as stable as fully-captured bottles.

SUMMARY OF THE INVENTION

A crate according to one embodiment of the present invention includes a base, a pair of opposed side walls extending upward from the sides of the base and a pair of end walls extending upward from ends of the base. The end walls each include a pair of spaced apart end columns A handle extends across the pair of spaced apart columns at each end wall. The height of the handle is aligned with a portion of the bottle having a reduced diameter. For example, some bottles have a tapered or contoured middle portion to facilitate grasping the bottle. By aligning the height of the handle with the taper or contour, the space for the user's hand is increased. This allows the handle to be positioned closer to the bottles, which reduces the overall length of the crate. The reduced length of the crate then permits a reduced width of the crate per the required ratio for cross-stacking. The reduced width then permits a full bottle capture on the bottom surface of the crate.

These and other features of the application can be best understood from the following specification and drawings, the following of which is a brief description.

DETAILED DESCRIPTION OF THE PREFERRED EMBODIMENT

Figure 1:
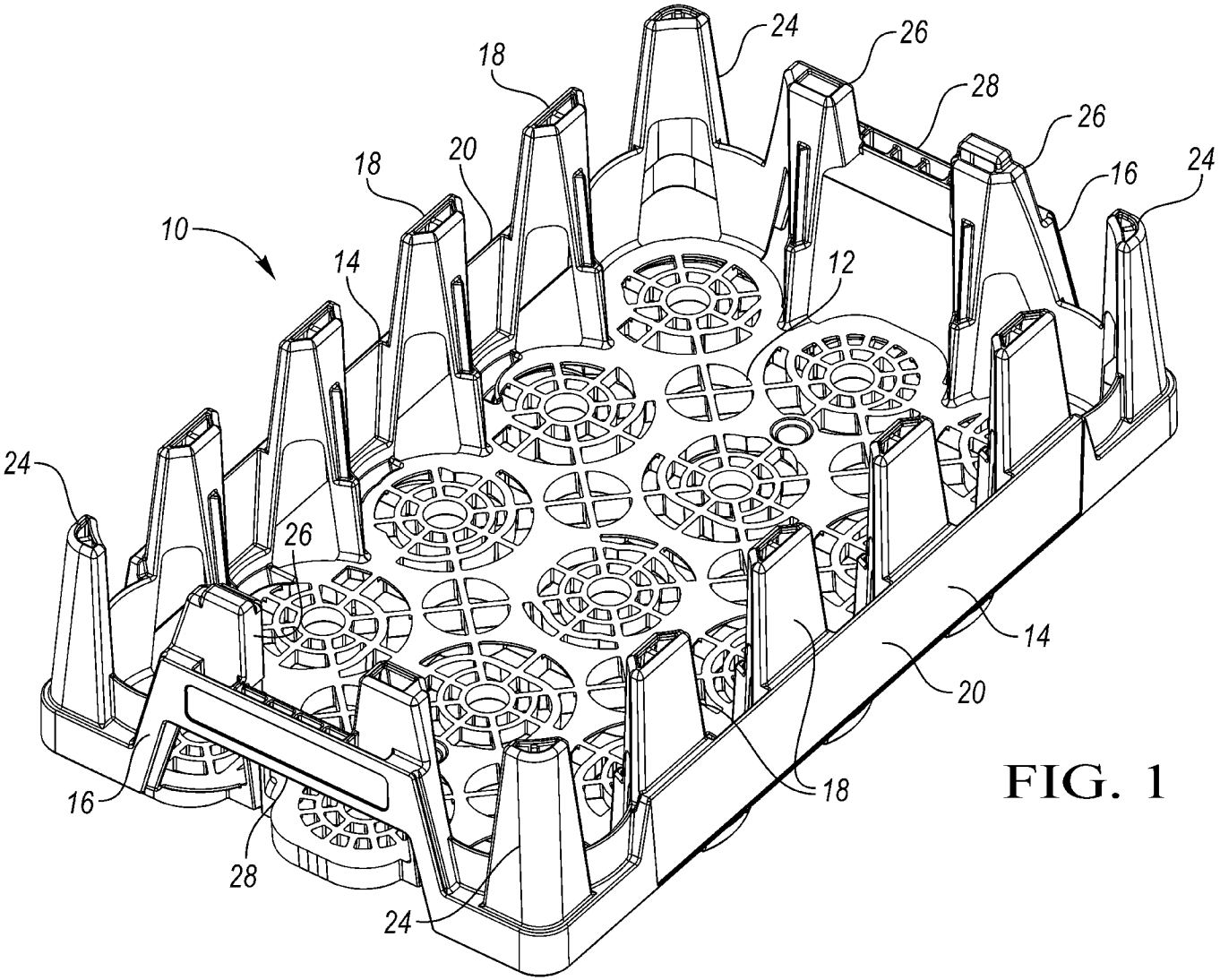
FIG. 1 is a perspective view of a crate according to one embodiment of the present invention.

A crate 10 according to one embodiment of the present invention is shown in FIG. 1. The crate 10 includes a base 12, which may include a plurality of interconnected ribs. The crate 10 further includes a pair of opposed side walls 14 extending upward from side edges of the base 12. End walls 16 extend upward from end edges of the base 12. The crate interior is defined between the side walls 14 and end walls 16.

A plurality of side columns 18 project upwardly from a lower portion 20 of the side walls 14. Corner columns 24 project upwardly at the intersection of the end walls 16 and side walls 14. End columns 26 project upwardly from a lower portion of the end walls 16. A handle 28 extends between the end columns 26 at each end wall 16. The handle 28 extends along outer edges of the end columns 26. The end columns 26 are tapered toward the interior of the crate 10 while the handle 28 extends upwardly nearly perpendicular to the base 12, along an outer footprint of the crate 10. This maximizes the amount of potential space between the handle 28 and the nearest adjacent bottle. The end columns 26 extend down to the base 12 on either side of a bottle-receiving area. The handle 28 is suspended between the end columns 26 and does not otherwise connect to the base 12.

Figure 2:
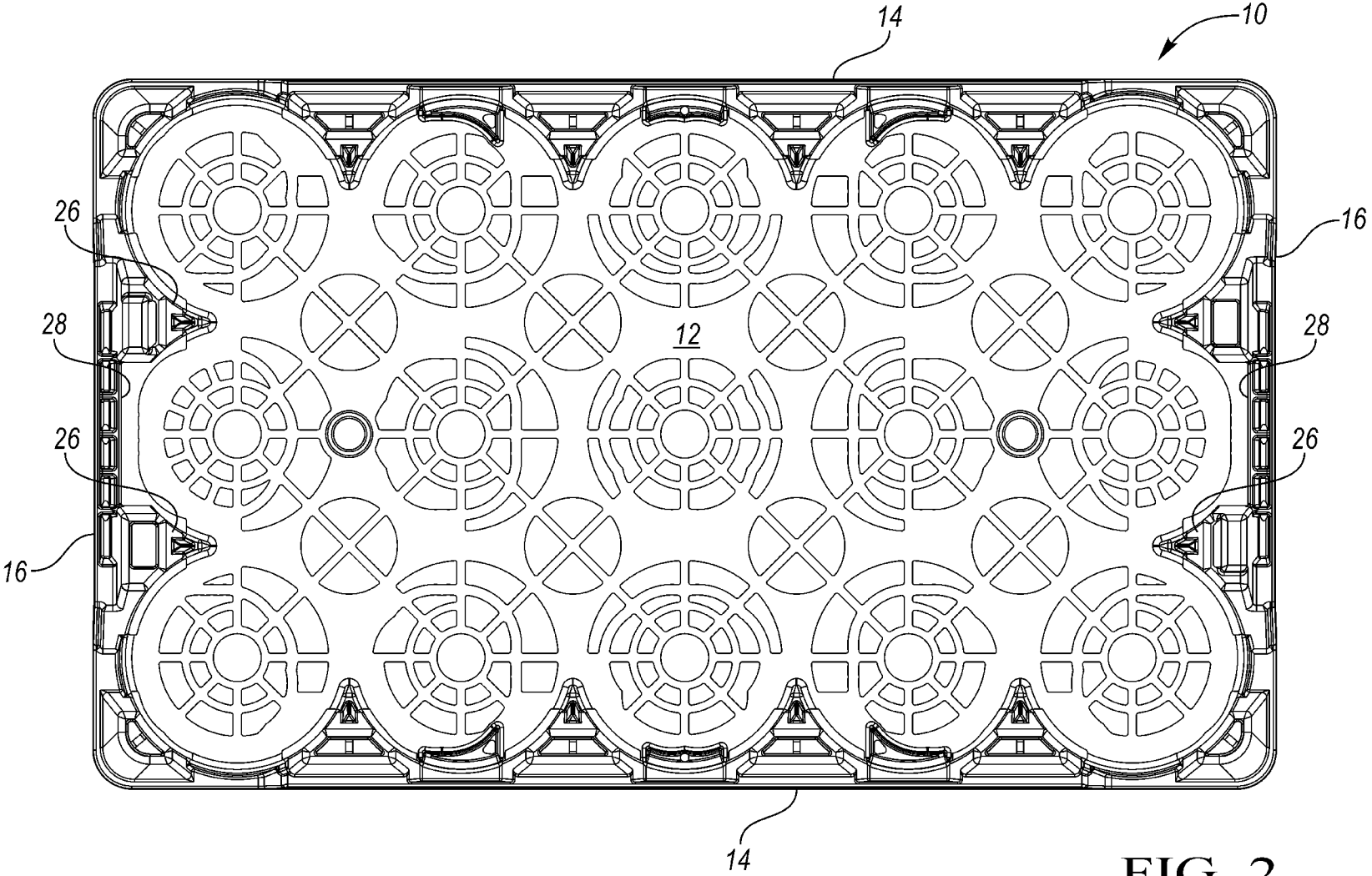
FIG. 2 is a top view of the crate of FIG. 1.

FIG. 2 is a top view of the crate 10. As shown, the handles 28 are positioned at the outer periphery of the footprint of the crate 10. As is also shown in FIG. 2 (which is to scale), the ratio of the length (end to end) of the footprint of the crate 10 relative to the width (side to side) is the same as the bottle ratio, in this example, 5×3. Other ratios could also be used (such as 4×3), but the benefit is primarily for an odd number of bottles along the end walls 16.

Figure 3:
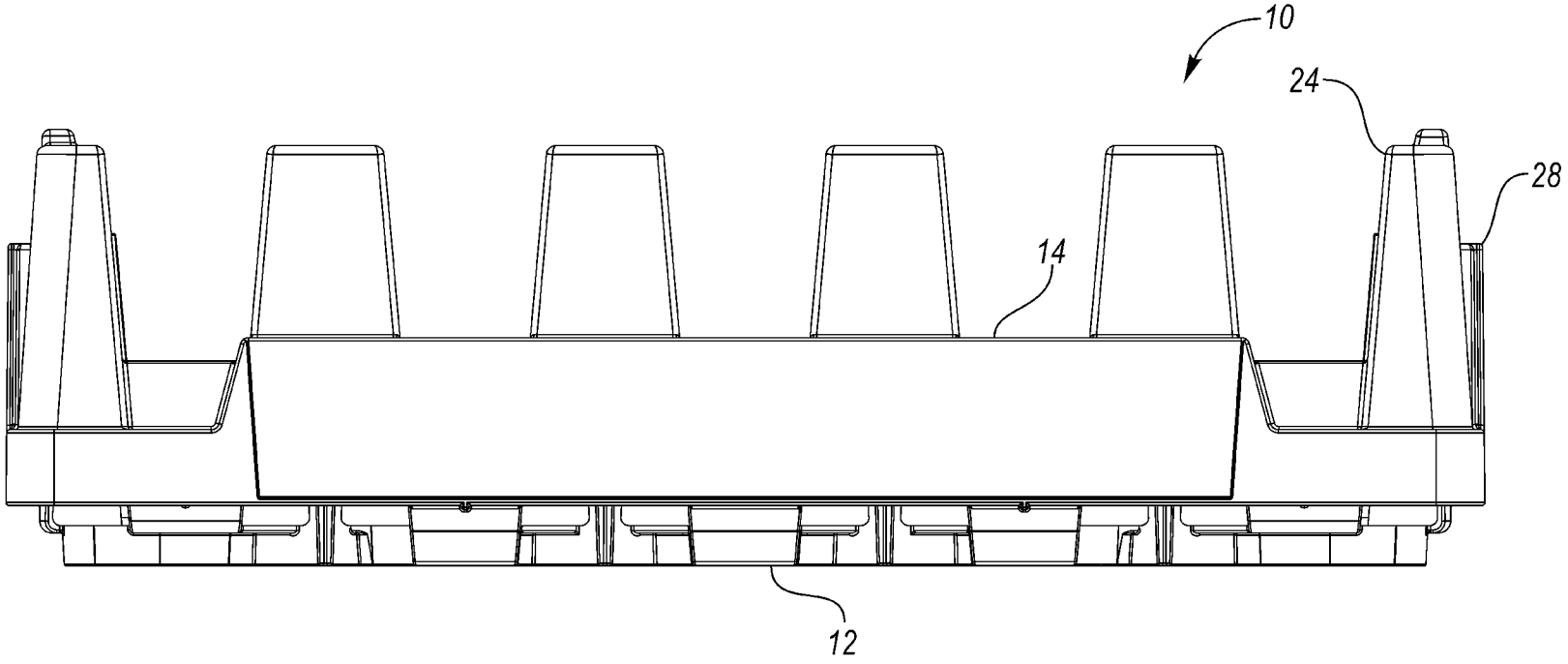
FIG. 3 is a side view of the crate of FIG. 1.
Figure 4:
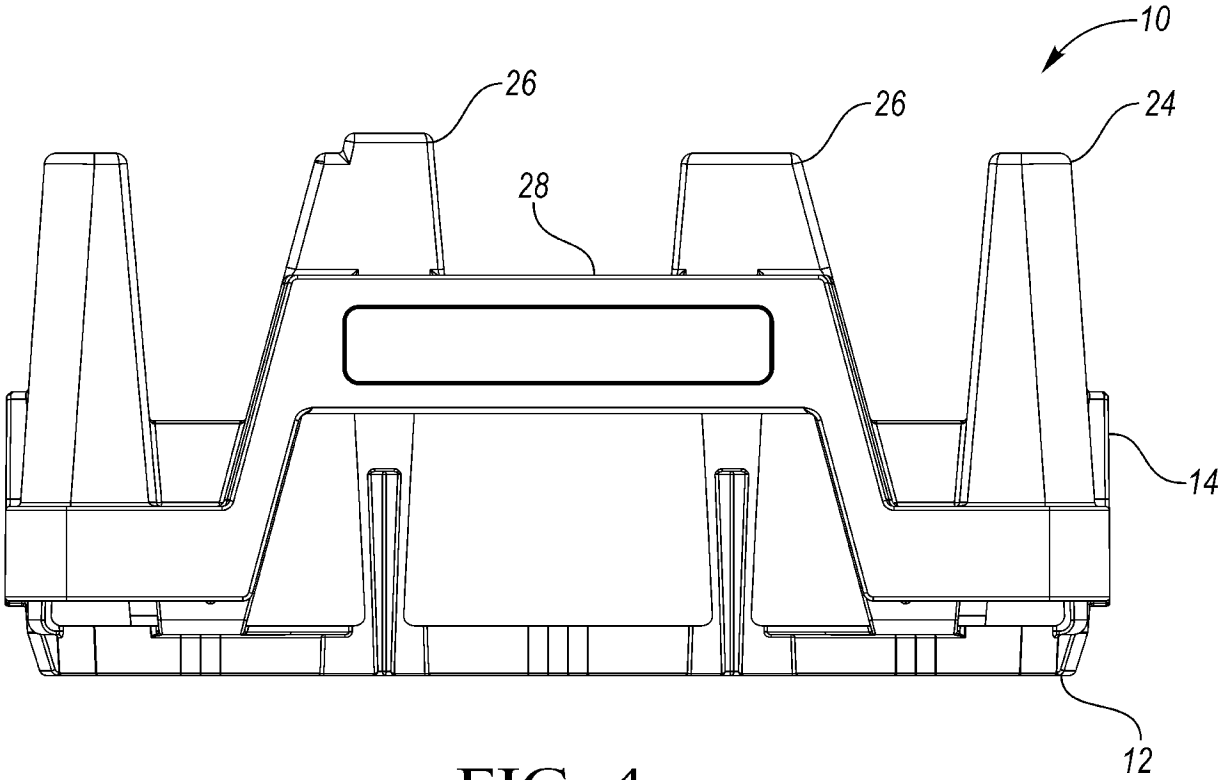
FIG. 4 is an end view of the crate of FIG. 1.

FIG. 3 is a side view of the crate 10. As is shown more clearly in FIG. 3, the handle 28 extends upward generally vertically relative to the base 12 along the outer footprint of the crate 10, while the columns taper inwardly. FIG. 4 is an end view of the crate 10.

Figure 5:
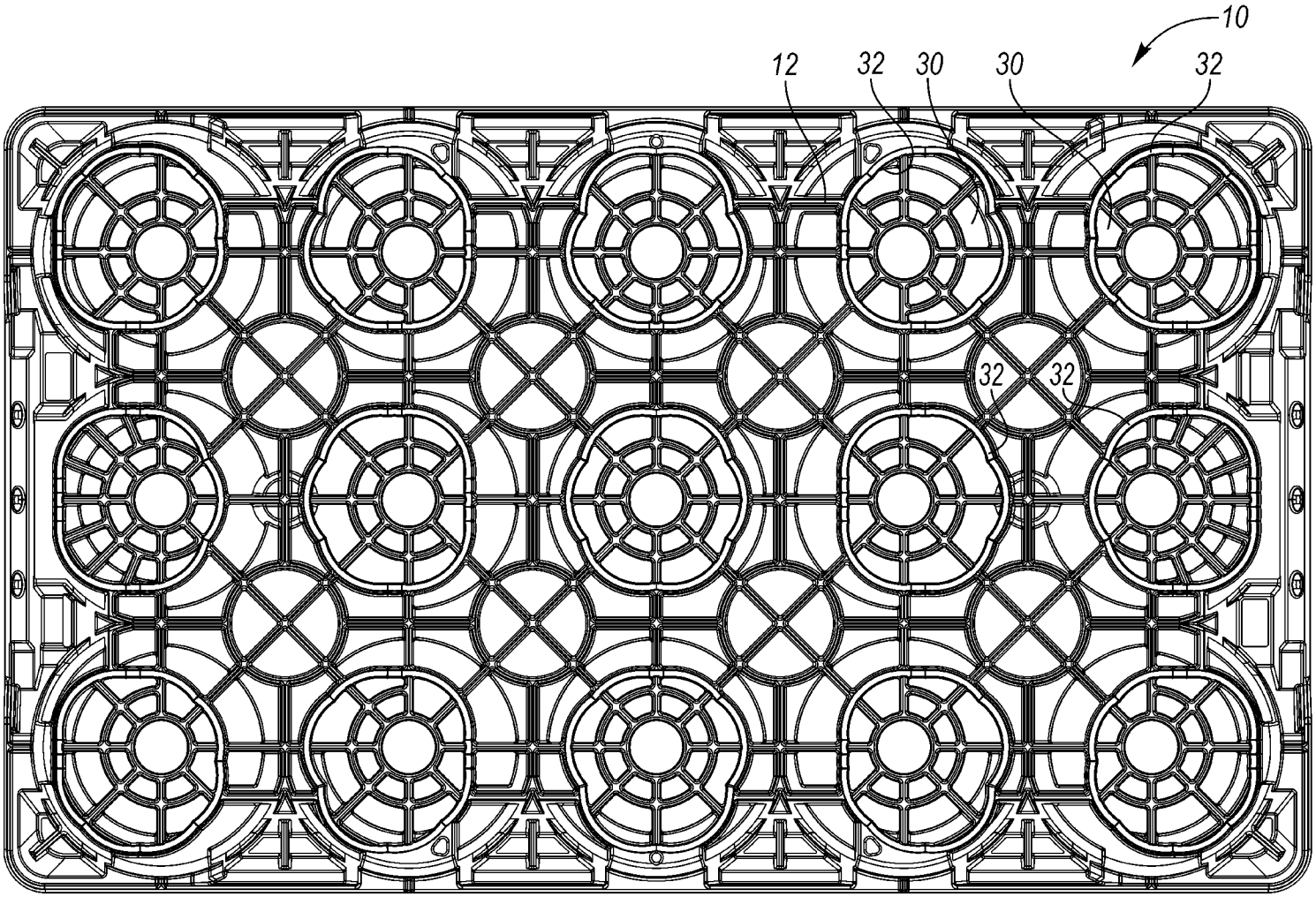
FIG. 5 is a bottom view of the crate of FIG. 1.

FIG. 5 is a bottom view of the crate 10. As shown, the base 12 includes a plurality of bottle-receiving recesses 30 for receiving the cap of a bottle on which the crate 10 is stacked. Each bottle-receiving recess 30 is completely circumscribed by a capture rib 32. In this embodiment, the bottle-receiving recesses 30 are arranged in three rows (i.e.

with three bottle-receiving recesses 30 aligned adjacent each end wall), but the advantages of the invention would be useful for any odd number of rows). In this embodiment, the bottle-receiving recesses 30 are arranged in a 3×5 array on the underside of the base 12. Each capture rib 32 captures a bottle cap of a bottle on which the crate 10 is stacked. Obviously, the capture rib 32 does not need to be completely continuous, as small breaks in the capture rib 32 would not affect its function. In the disclosed crate 10, the capture rib 32 is able to include portions at the periphery of the crate 10 because of the minimal footprint of the crate 10 relative to the bottles themselves. The capture rib 32 does not have breaks along the periphery of the base 12 that are larger than the caps of the bottles to be received.

Figure 6:
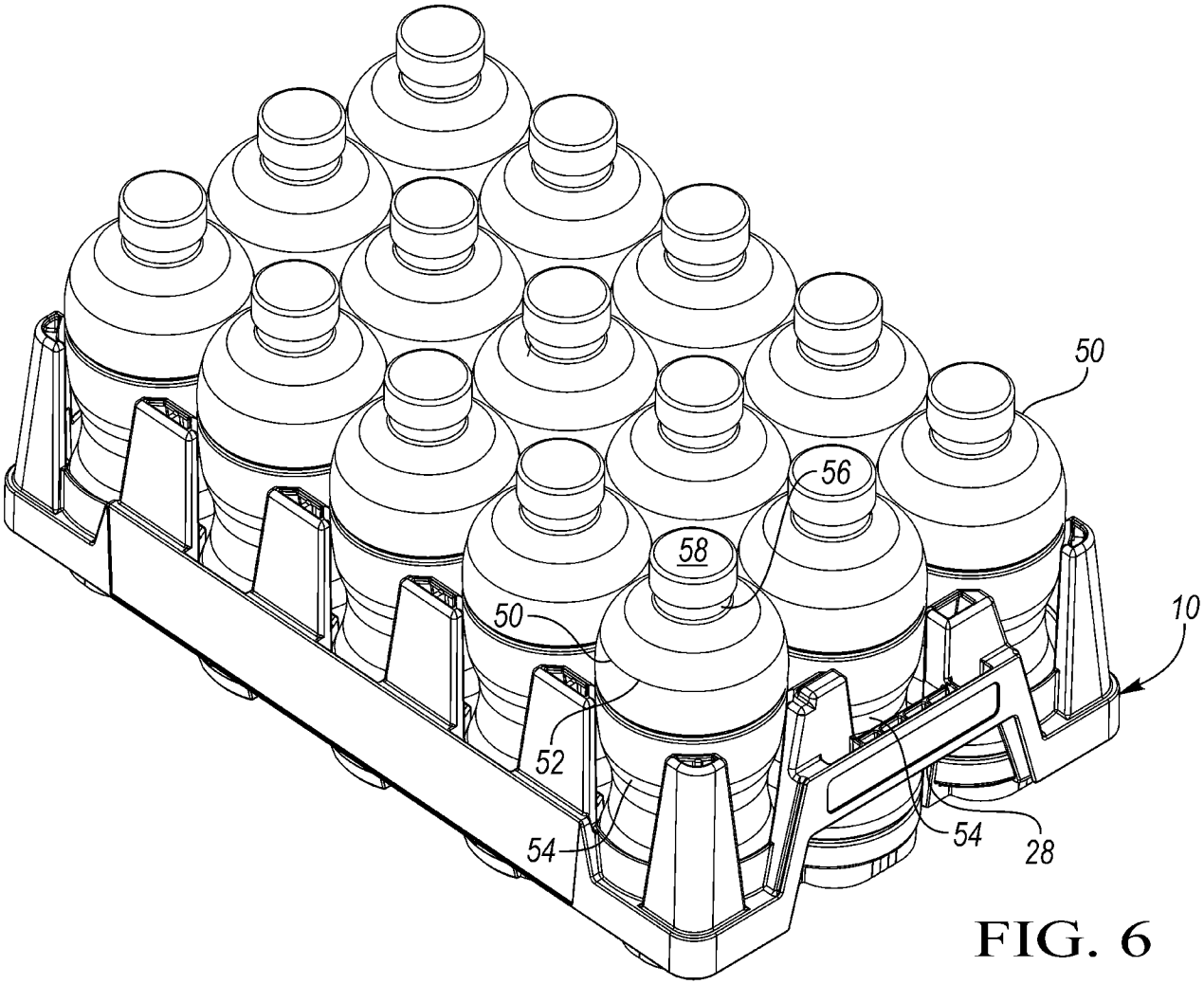
FIG. 6 illustrates the crate of FIG. 1 loaded with bottles.

FIG. 6 is a perspective view of the crate 10 with a plurality of bottles 50 stored therein. As shown, one of the bottles 50 abuts the end columns 26. The bottles 50 in this example are 28 oz and include a body 52 having a middle portion of reduced diameter 54 relative to portions of the body 52 below and above. The bottle 50 further includes a neck portion 56 on which is secured a bottle cap 58. The handle 28 of the crate 10 is vertically aligned with the portion of reduced diameter 54 of the bottle 50. This permits the handle 28 to be moved inward toward the interior of the crate 10 and reduce the footprint of the crate 10. There is a gap between the inner surface of the handle 28 and the reduced portion 54 of the adjacent bottle 50 in which the user can place their fingers when grasping the handle 28.

Figure 7:
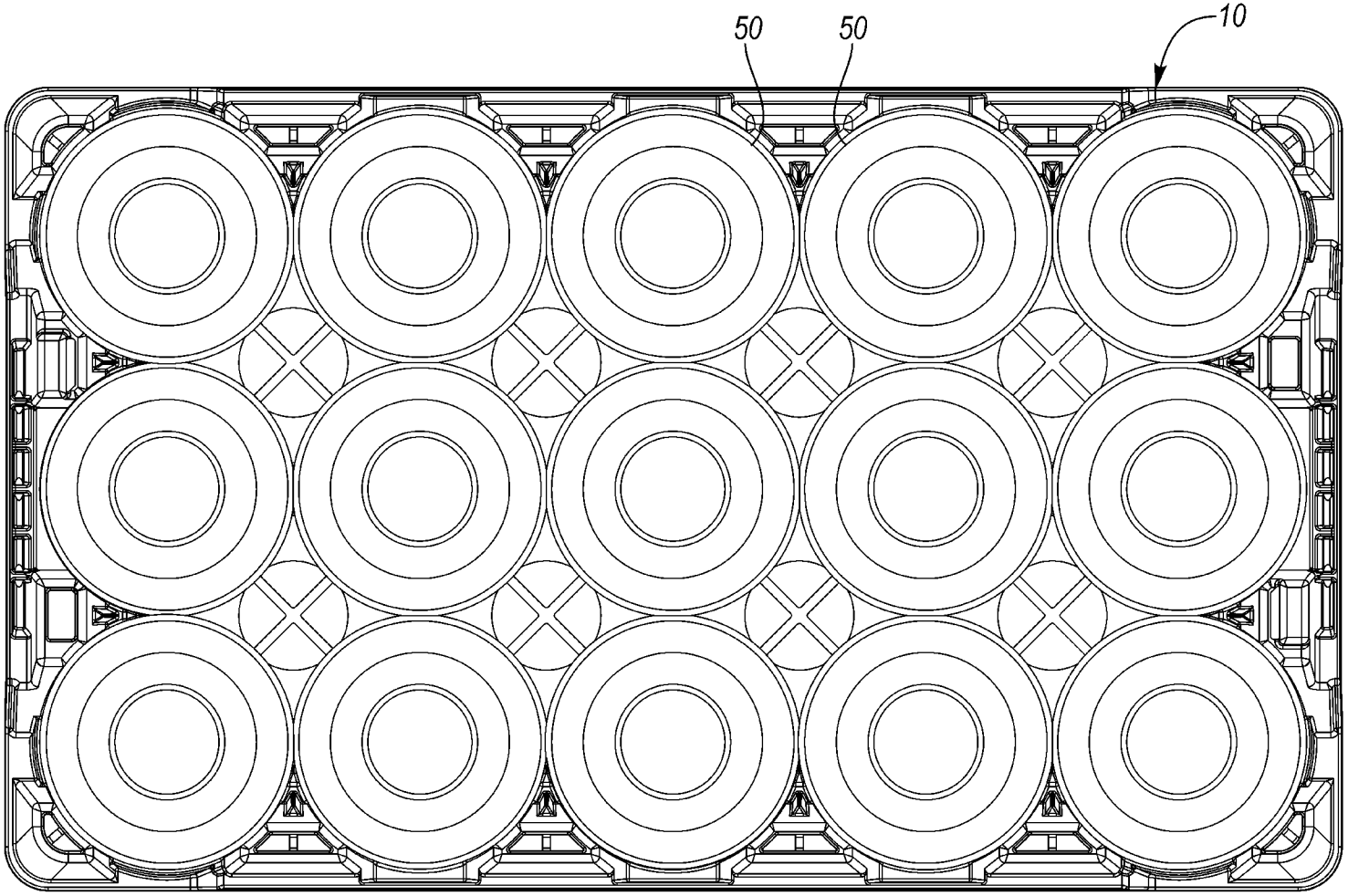
FIG. 7 is a top view of the crate and bottles of FIG. 6.
Figure 8:
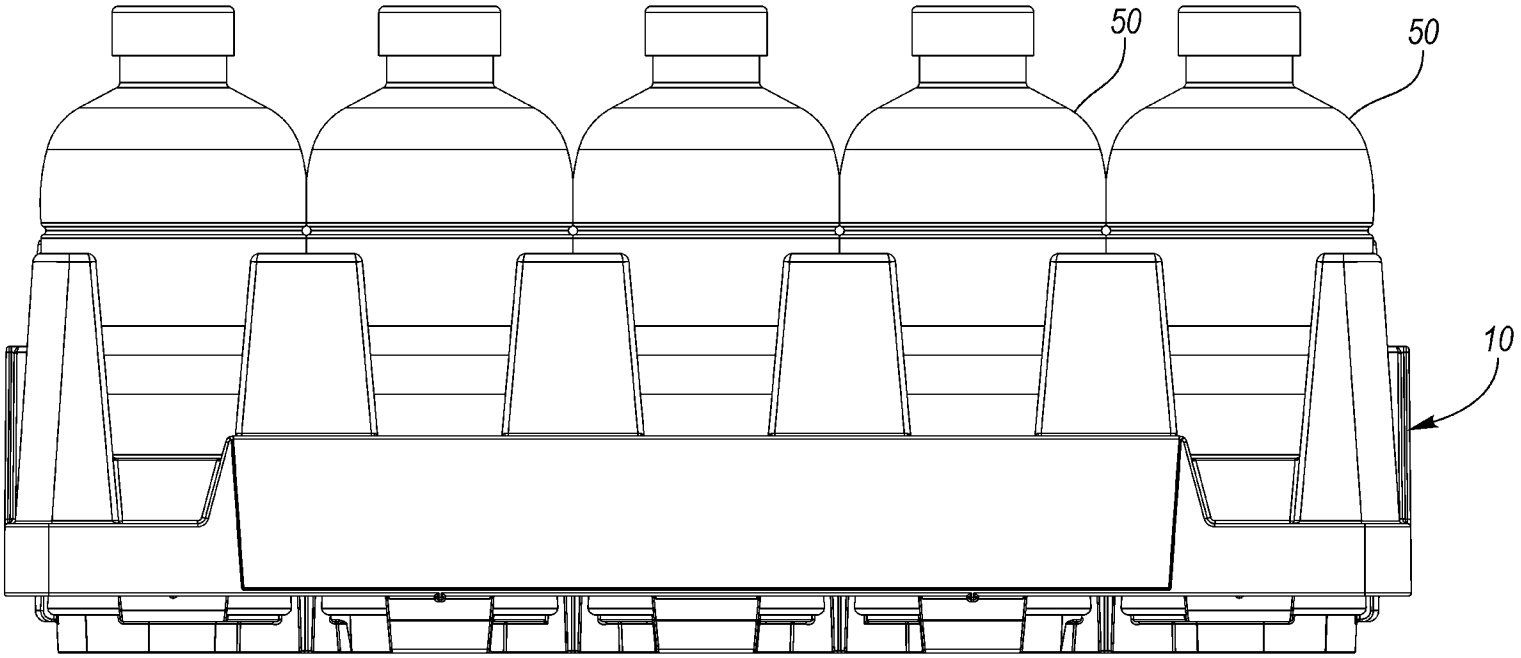
FIG. 8 is a side view of the crate and bottles of FIG. 6.
Figure 9:
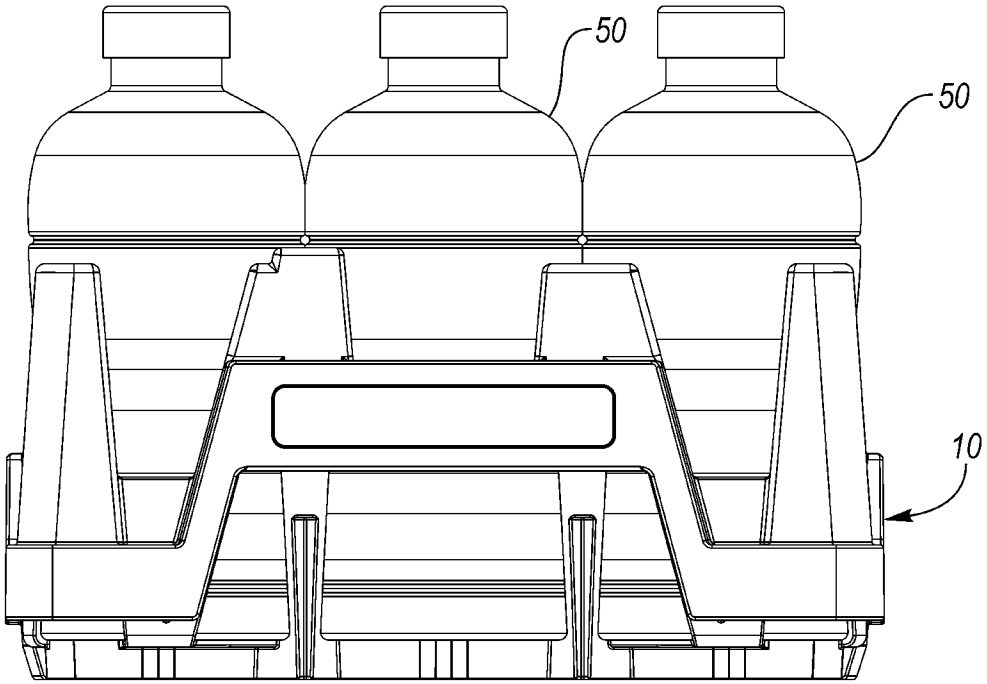
FIG. 9 is an end view of the crate and bottles of FIG. 6.
Figure 10:
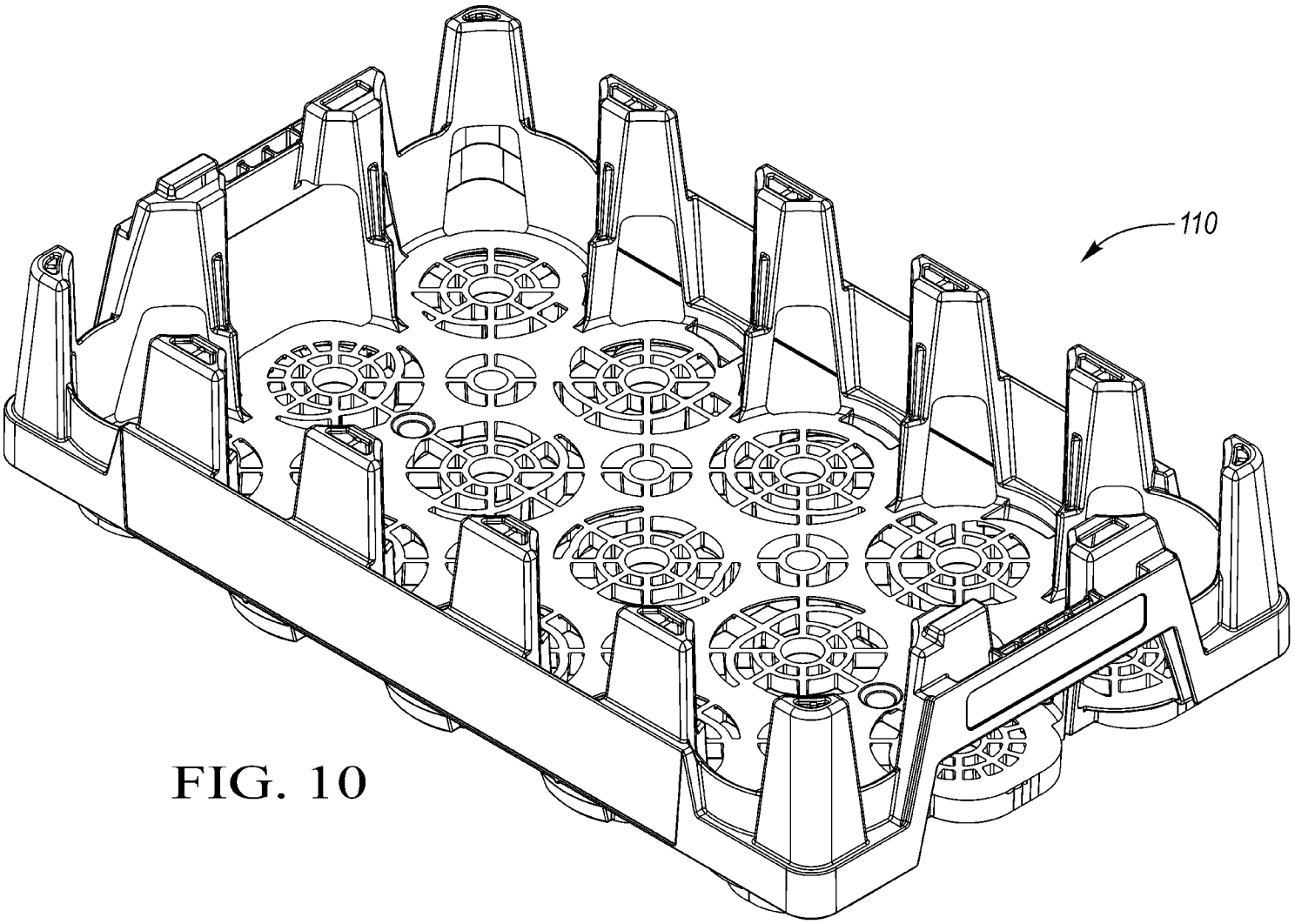
FIG. 10 is a perspective view of a crate according to another embodiment of the present invention.
Figure 11:
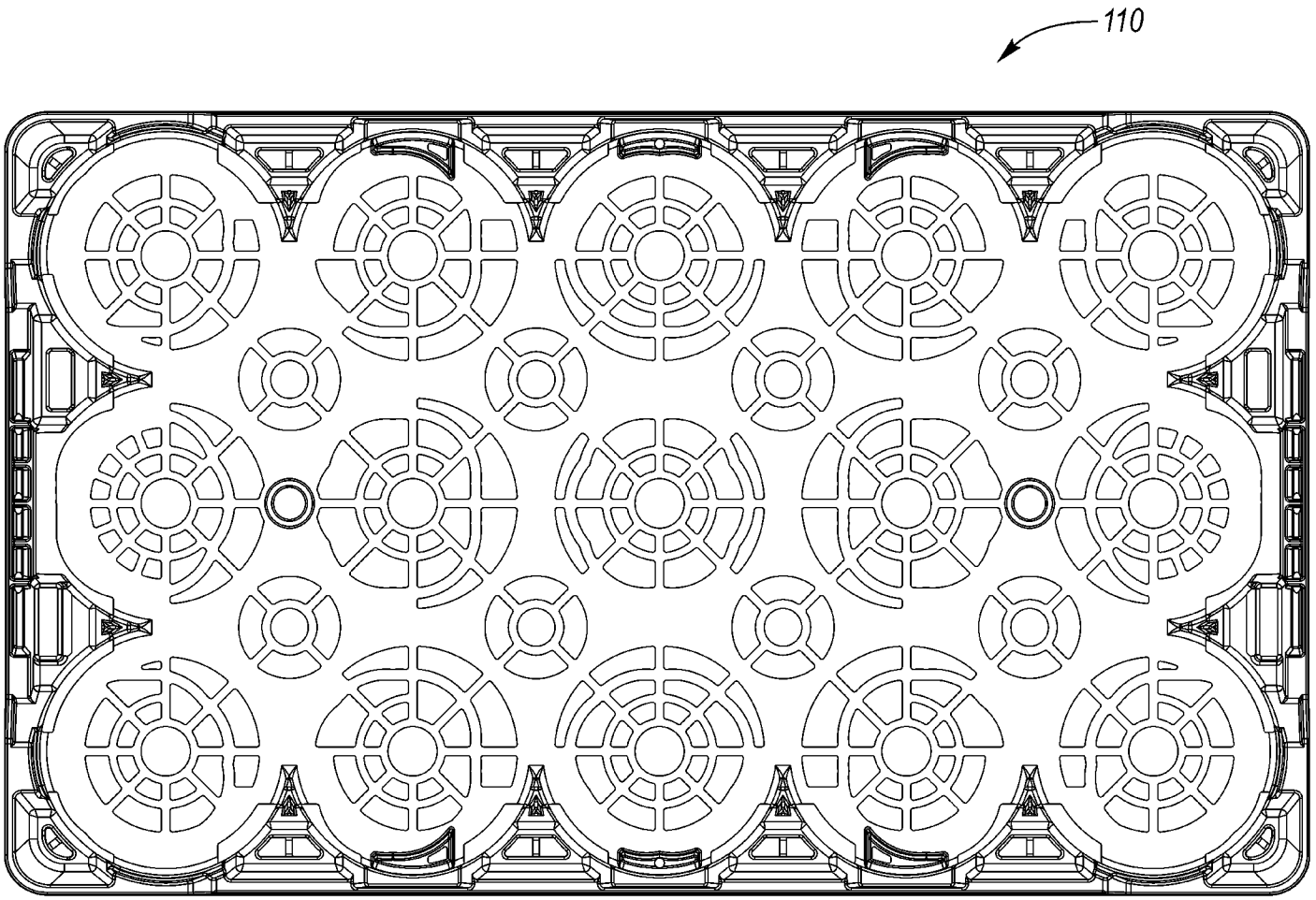
FIG. 11 is a top view of the crate of FIG. 10.
Figure 12:
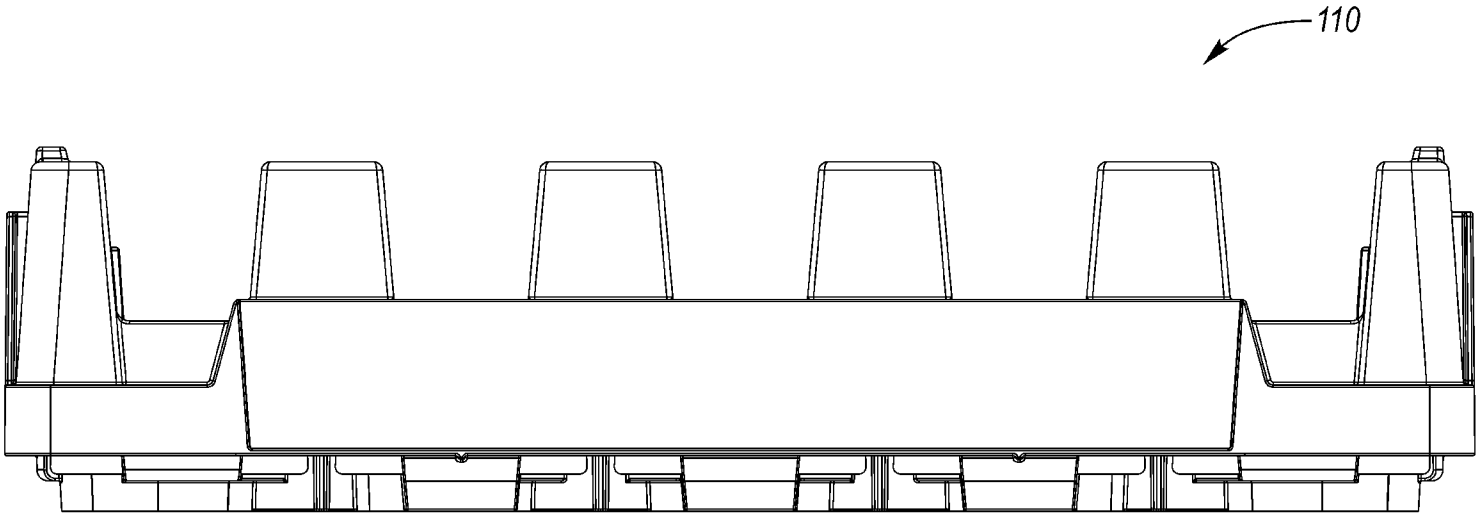
FIG. 12 is a side view of the crate of FIG. 10.
Figure 13:
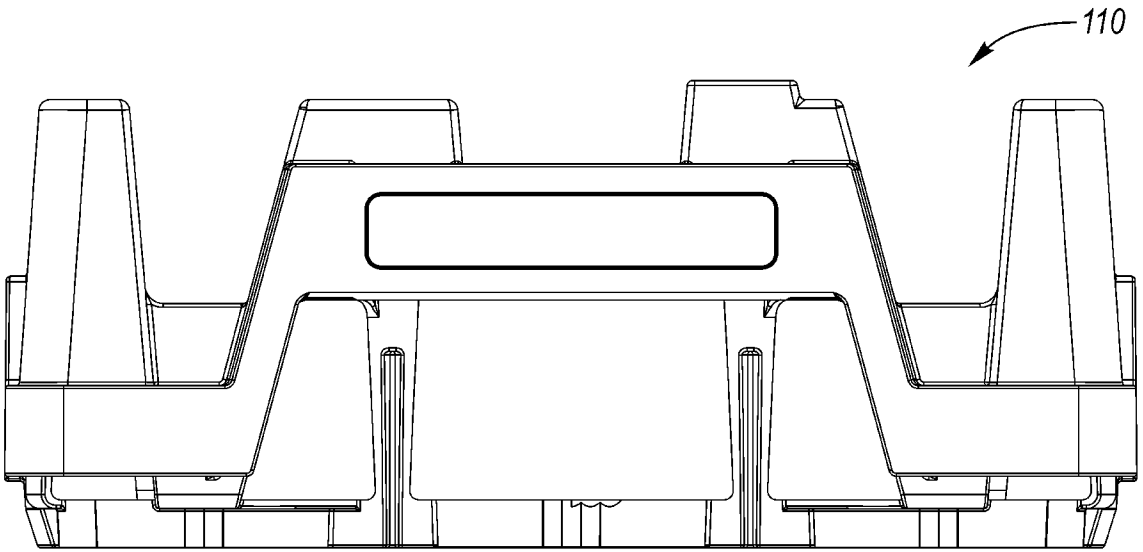
FIG. 13 is an end view of the crate of FIG. 10.
Figure 14:
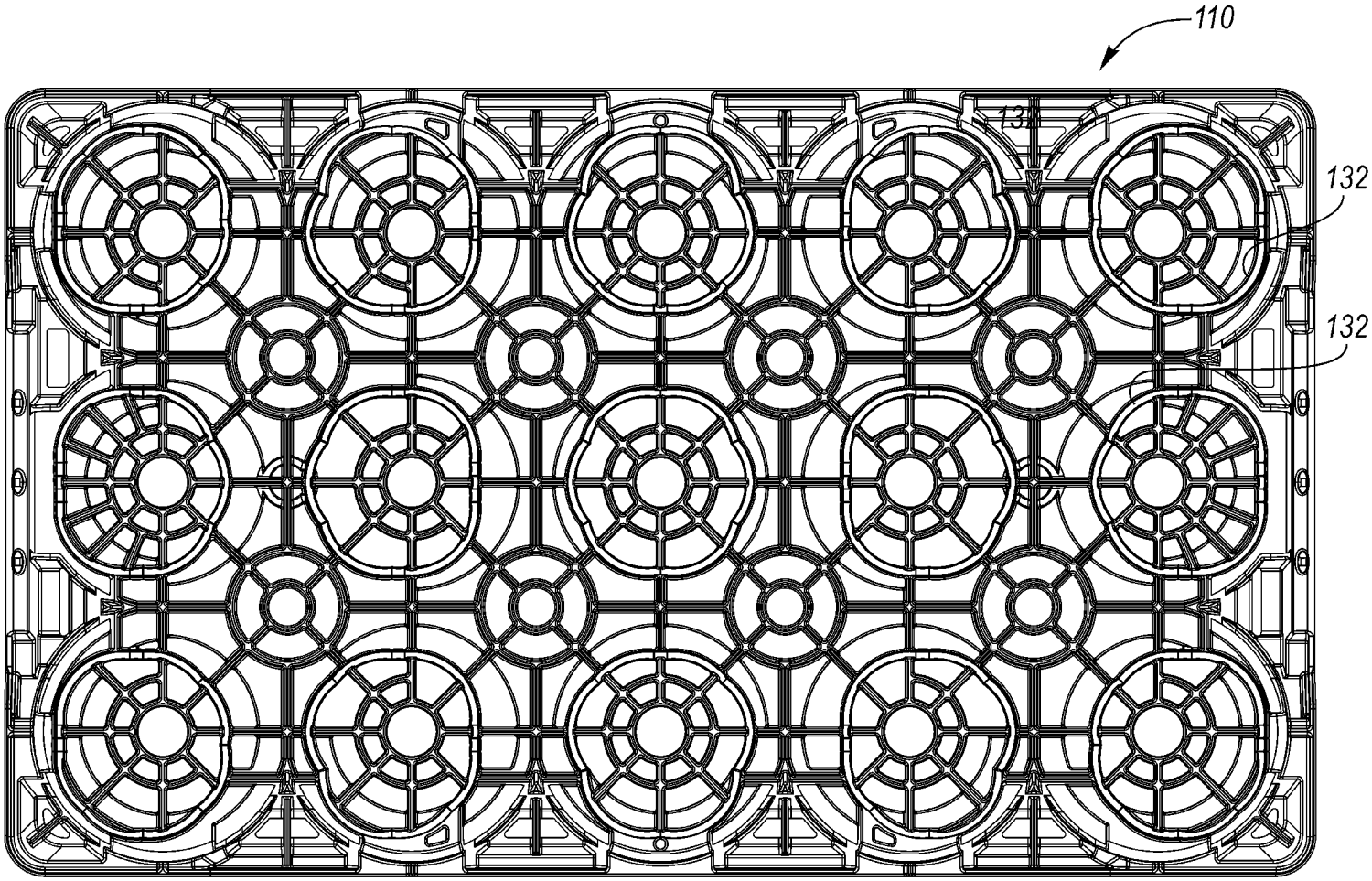
FIG. 14 is a bottom view of the crate of FIG. 10.
Figure 15:
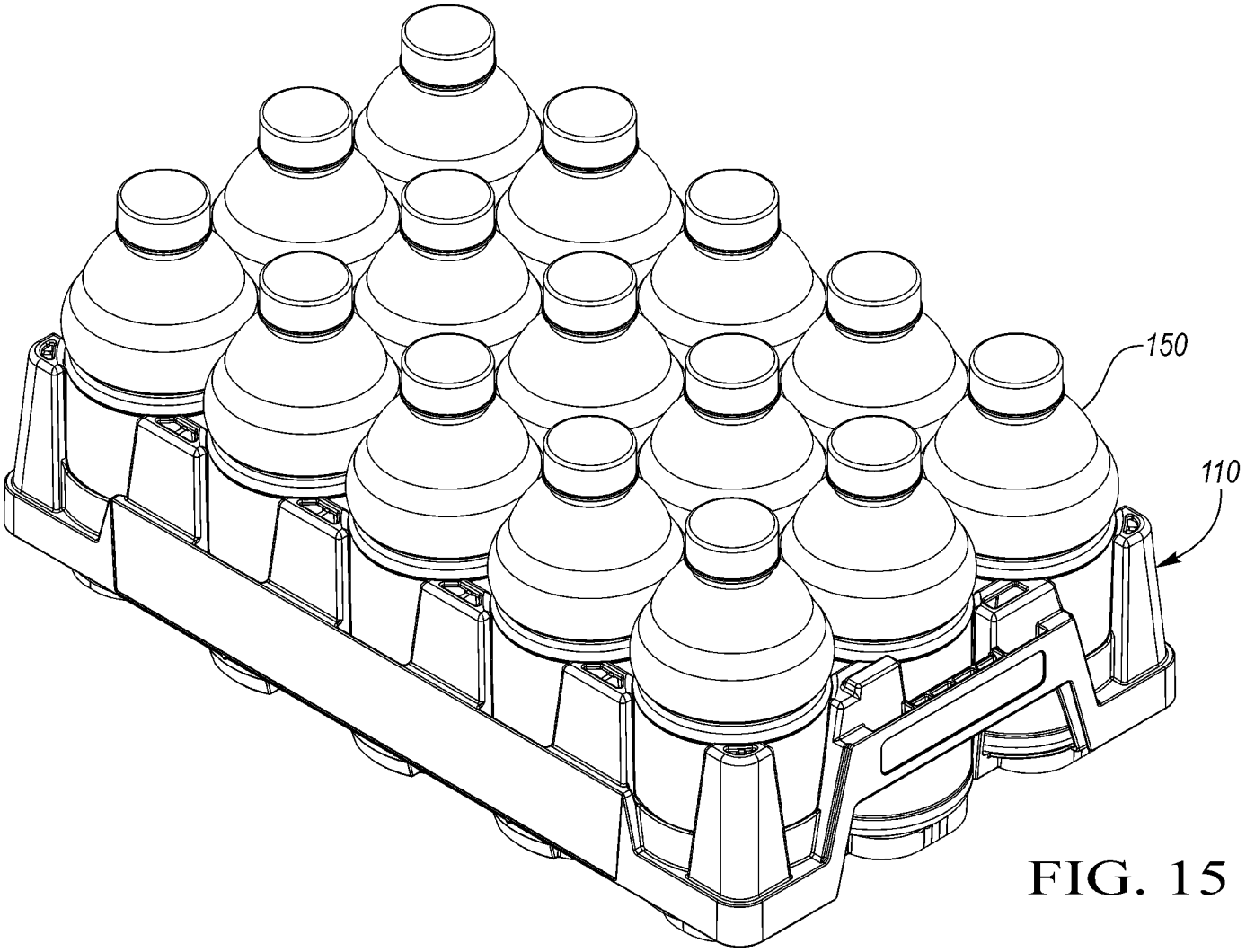
FIG. 15 illustrates the crate of FIG. 10 loaded with bottles.
Figure 16:
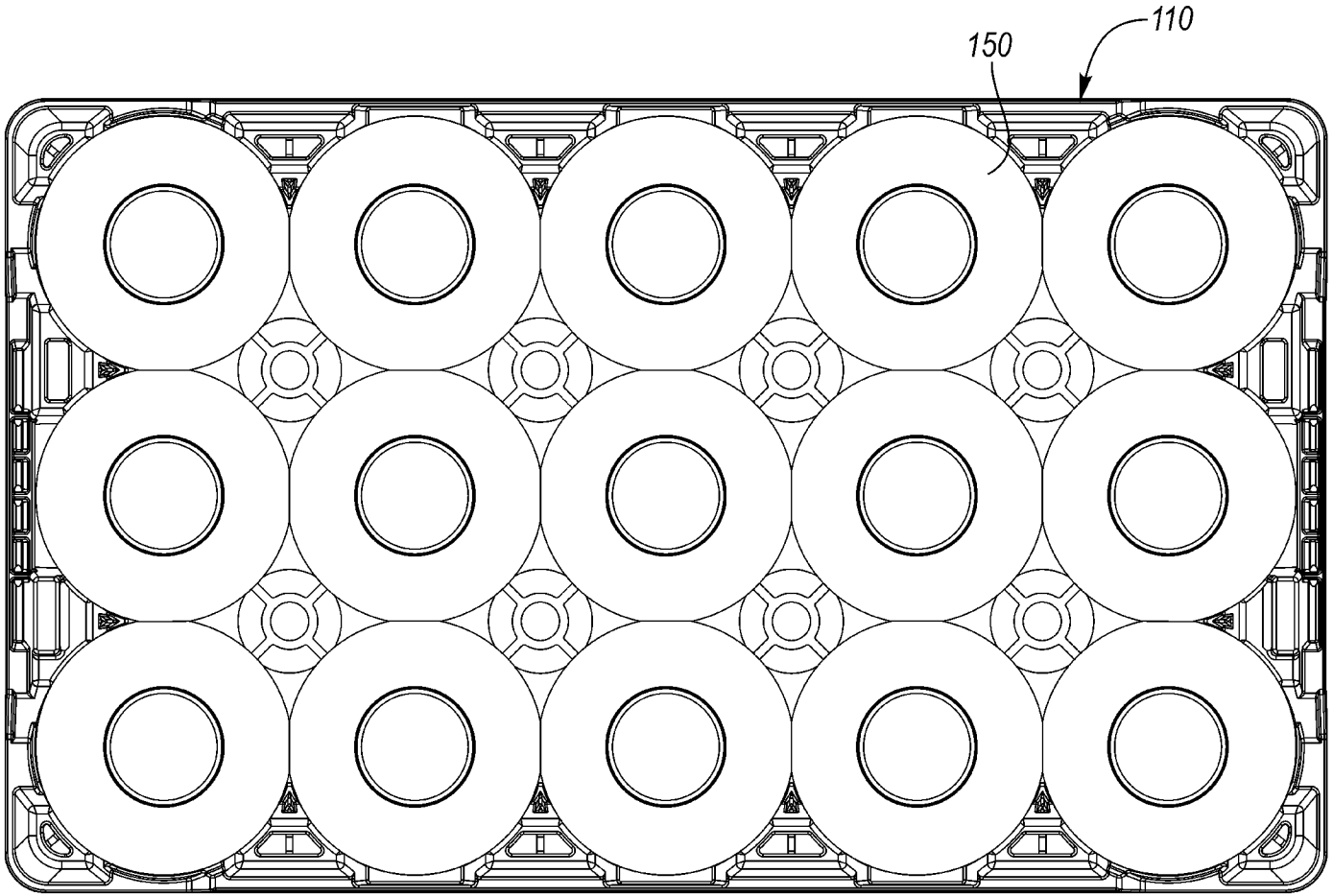
FIG. 16 is a top view of the crate and bottles of FIG. 15.
Figure 17:
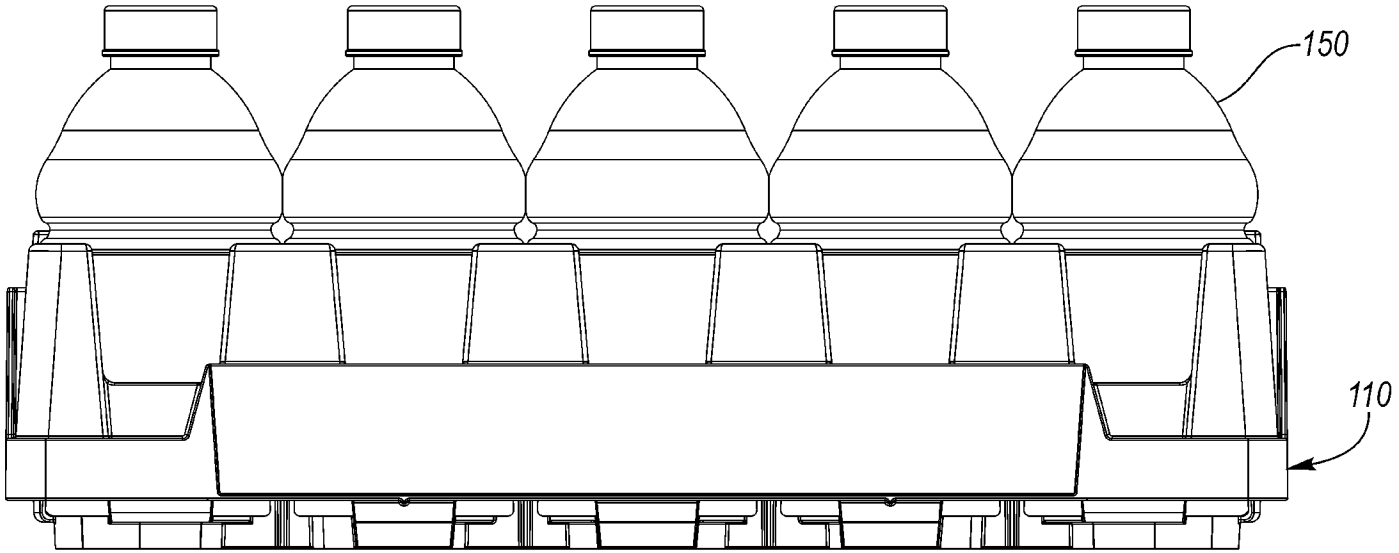
FIG. 17 is a side view of the crate and bottles of FIG. 15.
Figure 18:
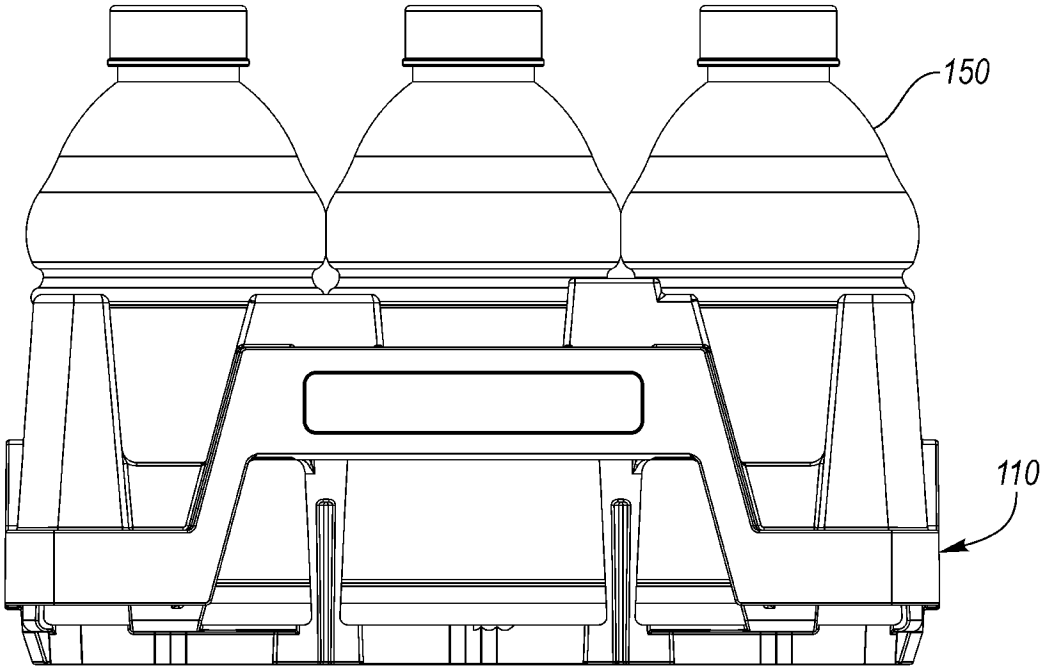
FIG. 18 is an end view of the crate and bottles of FIG. 15.

FIG. 7 is a top view of the crate 10 and bottles 50 of FIG. 6. FIG. 8 is a side view of the crate 10 and bottles 50 of FIG. 6. FIG. 9 is an end view of the crate 10 and bottles 50 of FIG. 6.

The caps 58 of the bottles 50 of a crate 10 would be received within the capture ribs 32 of the crate 10 stacked or cross-stacked thereon. With a 3×5 arrangement, the cross-stacking is more complicated than a 2×4 arrangement, but the cross-stacking arrangements are known and are accommodated by the capture ribs 32 of the crate 10.

Figure 19:
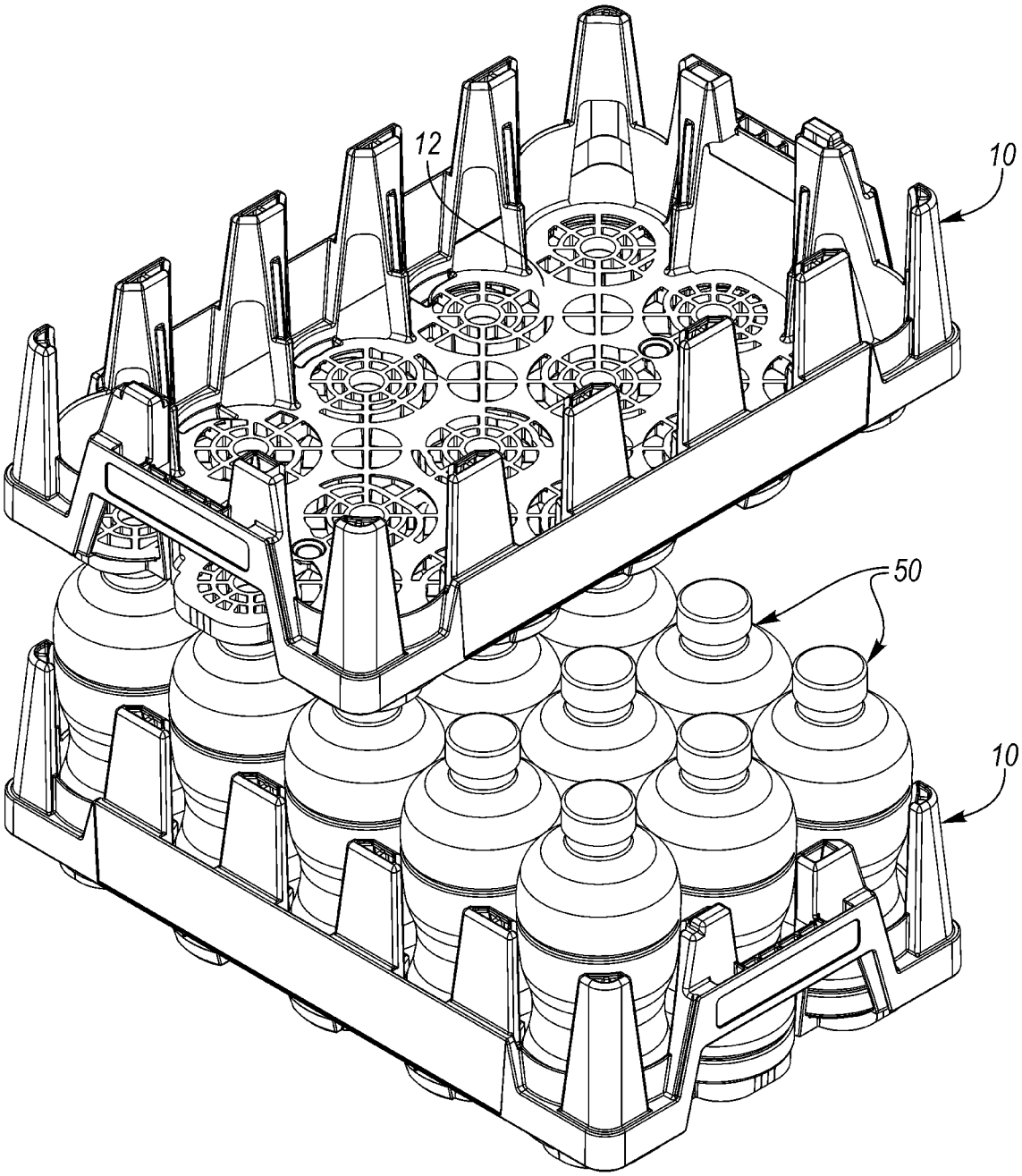
FIG. 19 is a perspective view of the crate of FIG. 1 cross stacked on an identical crate loaded with bottles.
Figure 20:
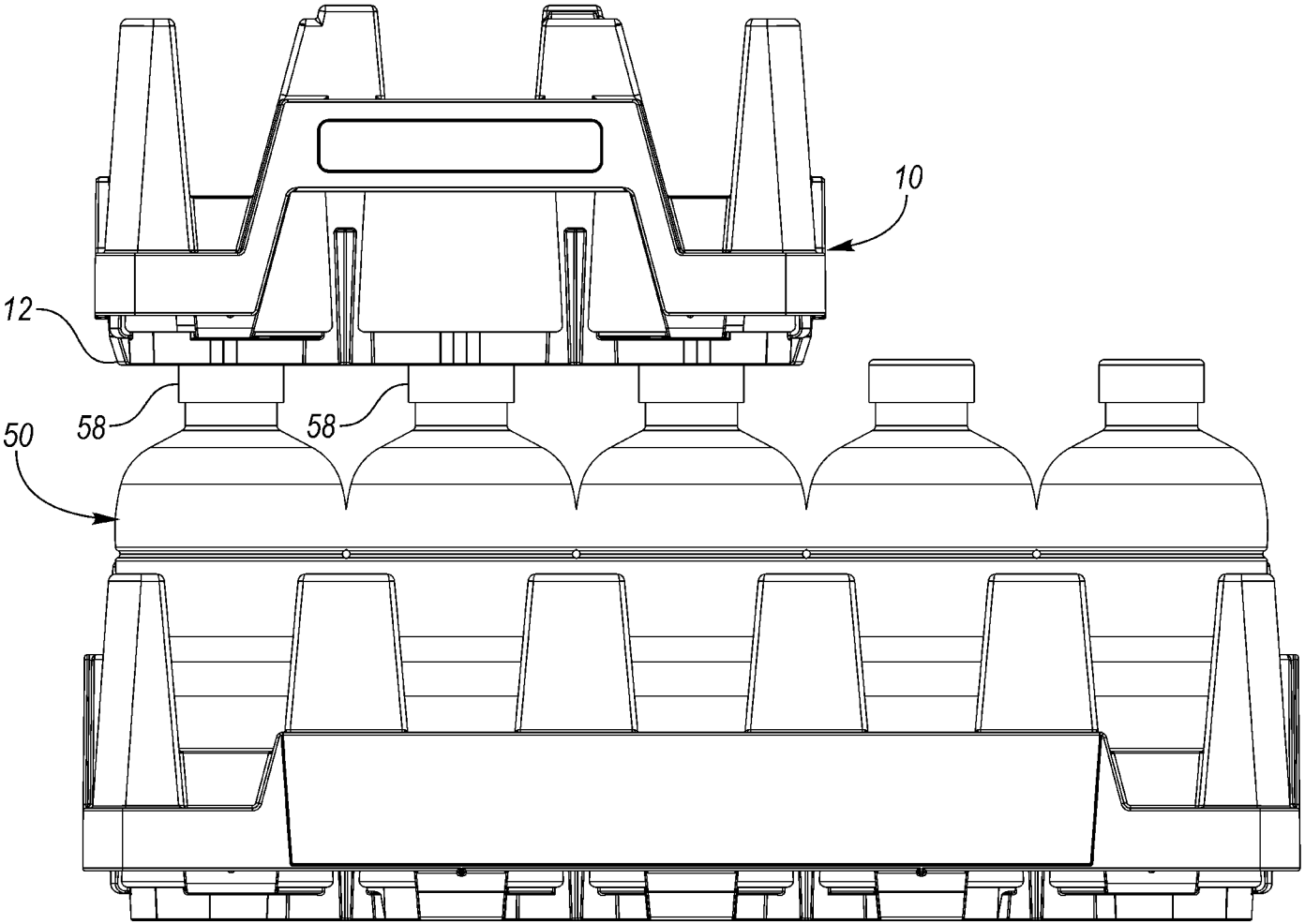
FIG. 20 is a side view of the crates and bottles of FIG. 19.
Figure 21:
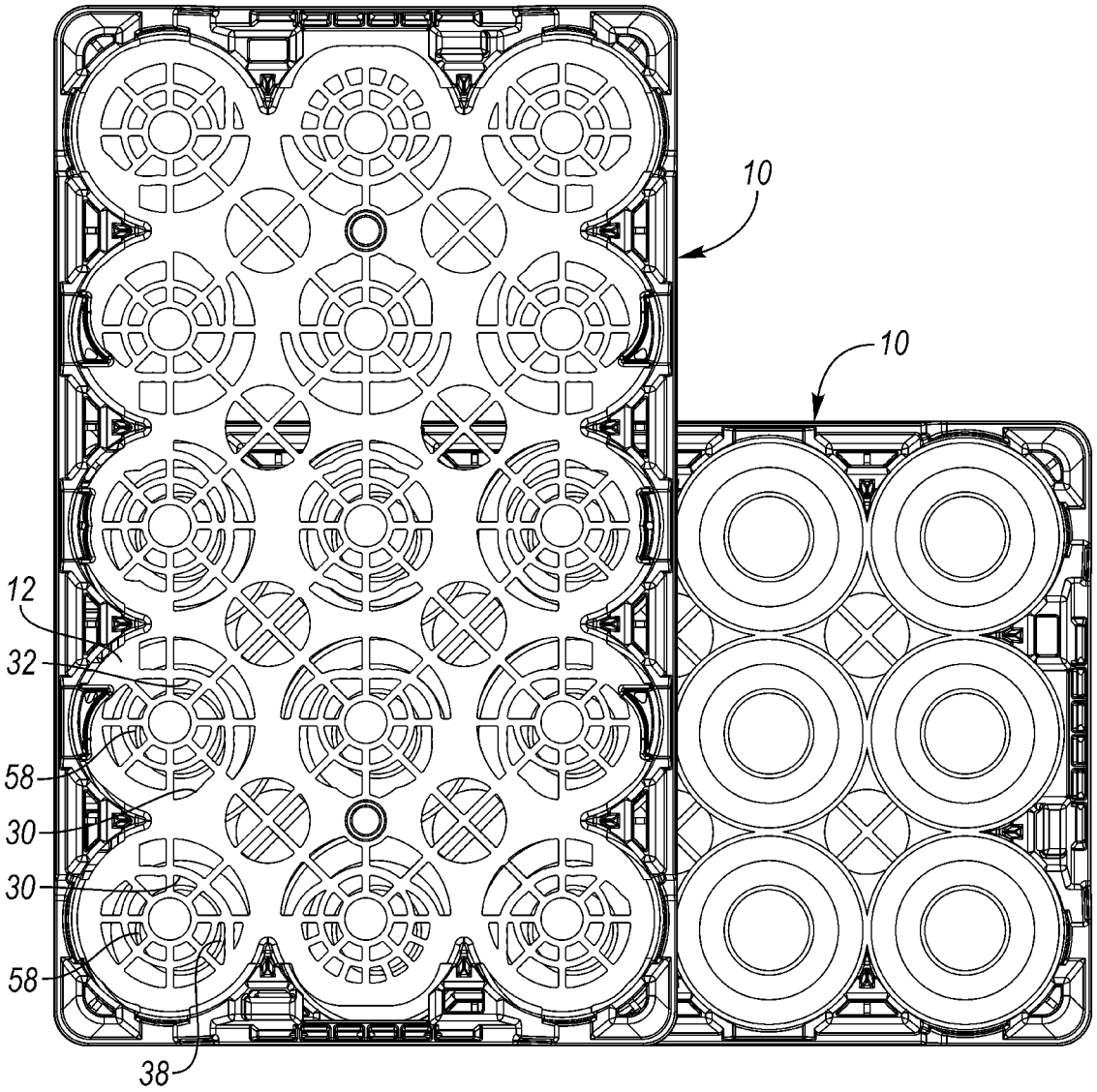
FIG. 21 is a top view of the crates and bottles of FIG. 19.

FIG. 19 is a perspective view of the crate 10 of FIG. 1 cross stacked on an identical crate 10 loaded with bottles 50. FIG. 20 is a side view of the crates 10 and bottles 50 of FIG. 19. FIG. 21 is a top view of the crates 10 and bottles 50 of FIG. 19. As can be seen in FIG. 21, the bottle caps 58 of the bottles 50 in the lower tray 10 are received in the bottle-receiving recesses 30 each within the capture ribs 38.

A crate 110 according to another embodiment of the present invention is shown in FIGS. 10-18. The crate 110 is generally the same as that in FIGS. 1-9 except as shown in the Figures or as described below. In particular, the tray is dimensioned a little differently to accommodate larger bottles 150 (e.g. 32 oz), as shown in FIGS. 15-18. The bottles 150 are not tapered as much, but there is some reduction in the diameter of the bottle 150 in the middle portion. Again, referring to FIG. 14, complete bottle capture is provided by the capture ribs 132, even along the periphery of the crate 110. The capture ribs 132 are shown as continuous, but could have openings that are smaller than the bottle caps (which are also larger in this example).

As is known, preferably both crates 10, 110 are each injection molded as a single piece of a suitable plastic, such as polypropylene, polyethylene or other suitable material.

In accordance with the provisions of the patent statutes and jurisprudence, exemplary configurations described above are considered to represent a preferred embodiment of the invention. However, it should be noted that the invention can be practiced otherwise than as specifically illustrated and described without departing from its spirit or scope.

What is claimed is:

1. A beverage crate and a plurality of bottles in combination comprising:

the beverage crate including a base, the base including a plurality of bottle capture recesses defined by capture ribs on an underside of the base, the plurality of bottle capture recesses including a plurality of side bottle capture recesses adjacent side edges of the base, wherein the capture ribs extend the along side edges of the base outward of each of the plurality of side bottle capture recesses;

the beverage crate further including a pair of opposed side walls extending upward from the side edges of the base and a pair of opposed end walls extending upward from end edges of the base, the plurality of bottle capture recesses on the base are arranged in a 3×5 array, each of the end walls including a handle extending from a first column to a second column, wherein the handle is spaced below uppermost edges of the first and second columns, wherein the crate can be cross-stacked on an identical crate when the identical crate is loaded with bottles; and the plurality of bottles loaded in the beverage crate and supported on the base in a 3×5 array, each of the bottles including a body having a middle portion of reduced diameter and a neck portion having a bottle cap thereon, wherein lowermost surfaces of the handles are aligned with the middle portion of reduced diameter, wherein the beverage crate and plurality of bottles can be cross-stacked on an identical beverage crate and plurality of bottles with a first subset of the bottle caps of the plurality of bottles on the identical beverage crate received in the plurality of side bottle capture recesses within the side capture ribs.

2. The beverage crate and plurality of bottles of claim 1 wherein the plurality of bottle capture recesses on the base are arranged in exactly three rows with exactly three bottle capture recesses arranged adjacent each end wall.

3. The beverage crate and plurality of bottles of claim 2 wherein the handles are positioned at outer portions of the first columns and the second columns, and wherein the first column and second column at each end wall abuts one of the plurality of bottles.

4. The beverage crate and plurality of bottles of claim 1 wherein the handles are positioned at the outer periphery of a footprint of the crate.

5. The beverage crate and plurality of bottles of claim 1 wherein the handles are positioned at outer portions of the first columns and the second columns, and wherein the first column and second column at each end wall abuts one of the plurality of bottles.

6. The beverage crate and plurality of bottles of claim 5 wherein the body of each of the plurality of bottles is generally cylindrical having an axis perpendicular to the base.

7. The beverage crate and plurality of bottles of claim 1 having a plurality of bottles loaded therein, wherein the handles are positioned at outer portions of the first columns and the second columns, and wherein the first column and the second column at each end wall abuts one of the plurality of bottles.

8. The beverage crate and plurality of bottles of claim 7 wherein the plurality of bottle capture recesses on the base are arranged in exactly three rows with exactly three bottle capture recesses arranged adjacent each end wall.

9. The beverage crate and plurality of bottles of claim 7 wherein the beverage crate is configured such that a first plurality of identical beverage crates, including the beverage crate, could be cross-stacked on a second plurality of beverage crates loaded with bottles, wherein the second plurality of beverage crates are identical to the beverage crate.

10. The beverage crate and plurality of bottles of claim 1 wherein an uppermost surface of each of the handles is spaced below uppermost edges of the first column and the second column.

11. The beverage crate of claim 1 wherein the plurality of bottle capture recesses further includes end bottle capture recesses adjacent end edges of the base, wherein the capture ribs are side capture ribs and wherein the beverage crate further includes end capture ribs extending along the end edges of the base outward of each of the end bottle capture recesses, wherein the beverage crate and plurality of bottles are configured to be cross-stacked on the identical beverage crate and plurality of bottles with a second subset of the bottle caps of the plurality of bottles on the identical beverage crate received in the plurality of side bottle capture recesses within the end capture ribs.

12. A beverage crate and plurality of bottles in combination comprising:

the beverage crate including a base including a plurality of bottle capture recesses arranged in a 3×5 array, each of the bottle capture recesses defined by a capture rib on an underside of the base, wherein at least some of the capture ribs extend along side edges of the base;

the beverage crate further including a pair of opposed side walls extending upward from the side edges of the base, the side walls each including a plurality of side columns extending upward;

the beverage crate further including a pair of opposed end walls extending upward from end edges of the base, each of the end walls including a handle extending from a first column to a second column, wherein the handle is spaced below uppermost edges of the first and second columns, wherein the crate can be cross-stacked on an identical crate when the identical crate is loaded with bottles; and the plurality of bottles loaded in the beverage crate in a 3×5 array, each of the bottles including a body having a middle portion of reduced diameter and a neck portion having a bottle cap thereon, wherein a lowermost surface of each of the handles is aligned with the middle portion of reduced diameter of a center one of the three of the plurality of bottles adjacent the respective handle.

13. The beverage crate and plurality of bottles of claim 12 wherein the handles are positioned at the outer periphery of a footprint of the crate.

14. The beverage crate of claim 12 wherein the handles are positioned at outer portions of the first columns and the second columns, further including a plurality of bottles received in the beverage crate, and wherein the first column and second column at each end wall abuts one of the plurality of bottles.

15. An upper beverage crate loaded with a first plurality of bottles cross-stacked on a lower beverage crate loaded with a second plurality of bottles, wherein the upper beverage crate and the lower beverage crate are identical, the combination comprising:

the upper beverage crate and the lower beverage crate each including a base having a plurality of bottle capture recesses defined by capture ribs on an underside of the base, the plurality of bottle capture recesses including an odd number of capture recesses adjacent each end edge of the base such that one of the capture recesses adjacent each end edge is centered on the end edge, wherein the capture ribs extend along end edges of the base outward of each of the end bottle capture recesses;

the upper beverage crate and the lower beverage crate each further including a pair of opposed side walls extending upward from side edges of the base and a pair of opposed end walls extending upward from the end edges of the base, each of the end walls including a handle extending from a first column to a second column within a footprint of the crate, wherein the handle is spaced below uppermost edges of the first and second columns; and the first plurality of bottles loaded on the base of the upper beverage crate, each of the first plurality of bottles having a body with a middle portion of reduced diameter and a neck portion having a bottle cap thereon, wherein lowermost surfaces of the handles are aligned with the middle portion of reduced diameter;

wherein the upper beverage crate is cross-stacked on the lower beverage crate loaded with the second plurality of bottles, such that bottle caps of the second plurality of bottles in the lower beverage crate are received in the odd number of end bottle capture recesses adjacent one of the end edges of the base of the upper beverage crate.

16. The combination of claim 15 wherein the capture ribs also extend along the side edges of the base outward of the plurality of bottle capture recesses.

17. The combination of claim 15 wherein a subset of the plurality of bottle capture recesses are formed along one of the side edges of the base, and wherein the capture ribs also extend along the side edges of the base outward of the subset of the plurality of bottle capture recesses.

18. A beverage crate and a plurality of bottles comprising:

the beverage crate including a base, the base including a plurality of bottle capture recesses defined by capture ribs on an underside of the base, wherein the capture ribs extend along side edges of the base outward of each of the plurality of bottle capture recesses, the beverage crate further including a pair of opposed side walls extending upward from the side edges of the base, a pair of opposed end walls extend upward from end edges of the base, the plurality of bottle capture recesses on the base are arranged in a 3×5 array, each of the end walls including a handle extending from a first column to a second column, wherein the handle is spaced below uppermost edges of the first and second columns to align with tapered portions of bottles to be carried in the crate, wherein the crate can be cross-stacked on an identical crate when the identical crate is loaded with bottles; and the plurality of bottles loaded in the beverage crate, wherein the handles are positioned at outer portions of the first columns and the second columns, and wherein the first column and the second column at each end wall abuts one of the plurality of bottles, wherein an uppermost surface of each of the handles is spaced below uppermost edges of the first column and the second column, wherein each of the bottles includes a body having a middle portion of reduced diameter and a neck portion having a bottle cap thereon, wherein lowermost surfaces of the handles are aligned with the middle portion of reduced diameter.

* * * * *